United States Patent [19]

Rodgers et al.

[11] Patent Number: 4,560,318

[45] Date of Patent: Dec. 24, 1985

[54] BACK HOE FORK LIFTING DEVICE

[76] Inventors: Charles F. Rodgers; Herman R. Rodgers, both of 9007 Noroad, Jacksonville, Fla. 32210

[21] Appl. No.: 587,054

[22] Filed: Mar. 7, 1984

[51] Int. Cl.[4] ..... B66F 9/12

[52] U.S. Cl. ..... 414/724; 37/DIG. 3; 37/DIG. 12; 172/253

[58] Field of Search ..... 414/724, 912; 37/DIG. 3, 12; 172/245, 250, 253, 254

[56] References Cited

U.S. PATENT DOCUMENTS 2,421,472 6/1947 Way ..... 414/912 X 3,312,361 4/1967 Foster ..... 414/724

3,421,642 1/1969 Carter ..... 414/912 X 4,275,985 6/1981 Schremmer ..... 414/724 X

*Primary Examiner*—L. J. Paperner

*Assistant Examiner*—Donald W. Underwood

[57] ABSTRACT

This back hoe lifting device is for loading pipe from trucks easily. Primarily, it consists of a pair of support arms secured to the bucket portion of the back hoe vehicle, which adjustably receive an elongated upper bar, having a pair of fork arms attached. The device further includes a lower bar, which adjustably elevates on the fork arms and provides further support for the fork arms in their outwardly extended position.

1 Claim, 3 Drawing Figures

BACK HOE FORK LIFTING DEVICE

This invention relates to attachments for back hoe vehicles, and more particularly, to a back hoe fork lifting device.

The principal object of this invention is to provide a back hoe fork lifting device, which will be unique in design, so as to be employed to load and unload pipe from trucks.

Another object of this invention is to provide a back hoe fork lifting device, which will be adaptable to also string pipe, and will not use chains, which are dangerous when applied to P.V.C. pipes when slippage occurs.

Another object of this invention is to provide a back hoe fork lifting device, which will be of such design, as to require only one man to perform the task of loading and unloading pipe.

A further object of this invention is to provide a back hoe fork lifting device, which will be removably received on the bucket portion of the back hoe vehicle.

A still further object of this invention is to provide a back hoe fork lifting device, which will be easily adjustable to handle twenty foot lengths of pipe safely.

Other objects of the invention are to provide a back hoe fork lift device, which will be simple in design inexpensive to manufacture, rugged in construction, and easy to install.

These and other objects will become readily evident, upon a study of the specification and the accompanying drawing, in which.

Figure 1:
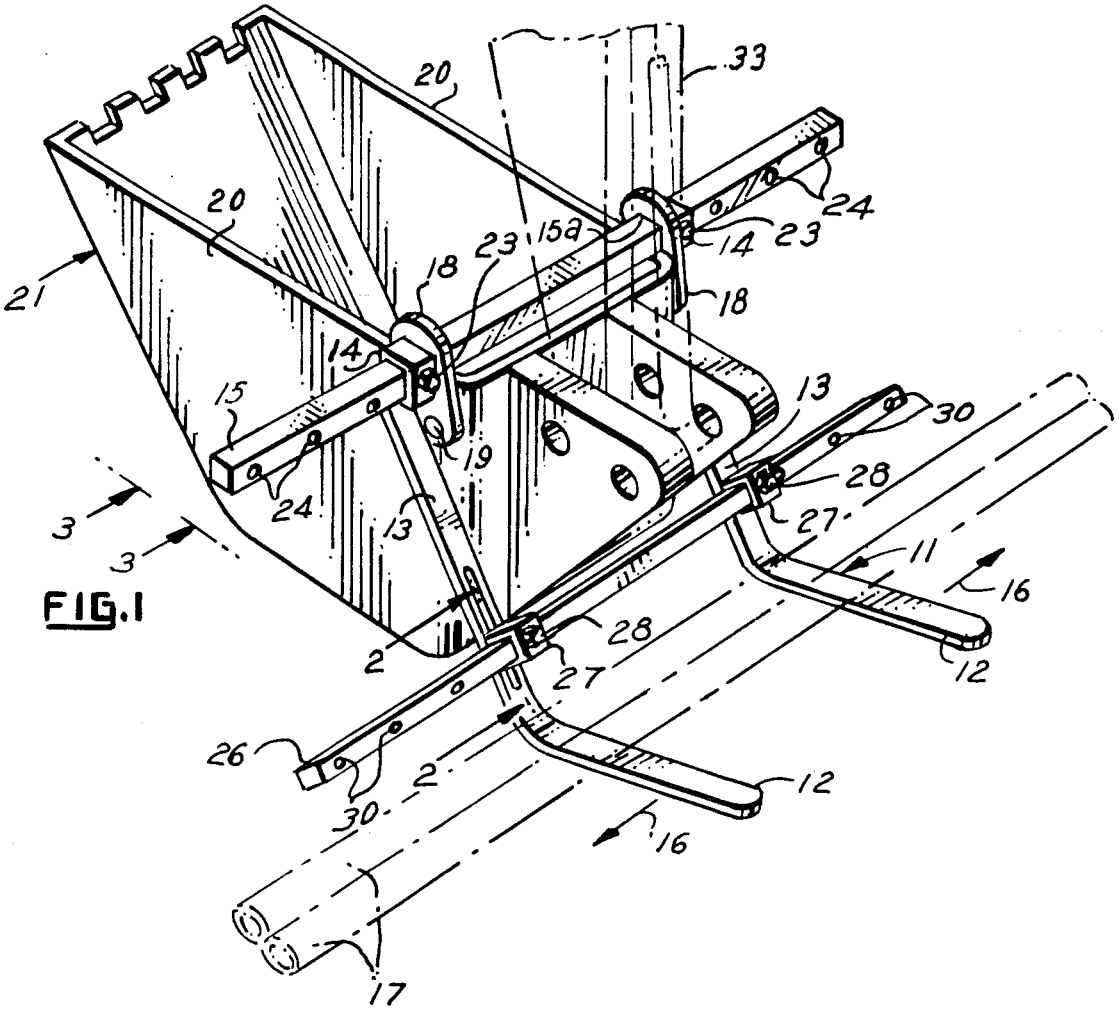
FIG. 1 is a perspective view of the present invention, shown installed on the bucket of a back hoe vehicle, and illustrates pipes thereon, in phantom.
Figure 2:
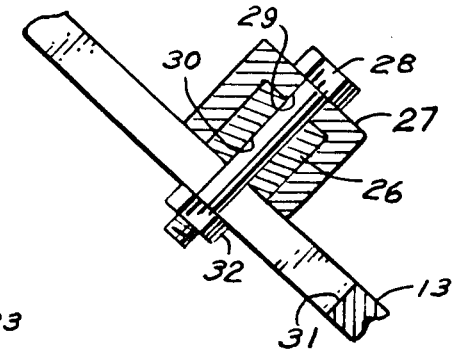
FIG. 2 is an enlarged cross-sectional view, taken along the line 2—2 of FIG. 1.
Figure 3:
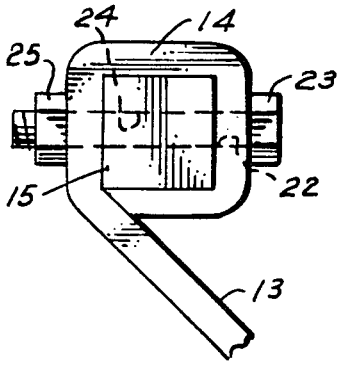
FIG. 3 is an enlarged view, taken along the line 3—3 of FIG. 1.

Accordingly, a device 10 is shown to include a fork 11, which consists of a pair of flat prongs 12, that are common in the art for loading and unloading vehicles. The prongs 12 are angularly formed at their upper portions 13, which are terminated by means of a box like eye 14, formed integrally therewith, and which freely and slideably receives an elongated steel bar 15, which in this instance, is of square cross-sectional configuration, which is preferably nine feet in length for horizontal adjustment of spread between the prongs 12 of fork 11, as indicated by means of the arrows 16. Bar 15 is also slideably received within the openings 15*a* of mounting arms 18 of device 10. The prongs 12 in this instance, provide a means of supporting pipe 17 in an angularly rearward and cradled manner, to be loaded from one vehicle to another. However, the function of device 10 is not limited to lifting and moving pipe, as it may be employed to lift and move other material, such as lumber, etc.

The lower ends of arms 18 are fixedly secured by bolt fasteners 19, to the rear portions of the side walls 20 of bucket 21 of a back hoe vehicle, which is not shown. Each eye 14 includes openings 22 therethrough, which freely receives a bolt fastener 23, and bolt fasteners 23 are also freely received through one of a plurality of spaced transverse openings 24, bored through bar 15. The fork 11 has its prongs 12 spread apart from each other, to any desired distance, by the bolt fasteners 23 being received in any of the aligned openings 24 chosen, and nut fasteners 25 are threaded onto bolt fasteners 23, so as to render the adjustment secure.

A second elongated bar 26 is provided and disposed adjustably below bar 15 on prongs 12, for increased rigidity and stability of fork 11 in picking up and supporting pipe 17, and bar 26 includes a pair of channel clamps 27, of "V"-shaped configuration, in which bar 26 is received slideably for the same type of adjustment, abovedescribed. A bolt fastener 28 is freely received in openings 29 of channel clamps 27, and is freely received within any of the desired transverse openings 30 through second bar 26, and bolt fasteners 28 are freely and adjustably received within the elongated cut-out openings 31 through each prong 13 of fork 11. Bolt fasteners 28 render bar 26 secured at any desired elevation on prongs 12, by nuts fasteners 32 being tightened thereon, and it shall be noted, that the upper bar 15 is disposed on top of the bucket 21 and is spaced from the support arm 33 of the back hoe vehicle, so as to prevent any interference therewith, when the vehicle is in operation.

In use, the back hoe vehicle is operated in the usual manner, with the exception, that the operator backs the bucket 21 in such a manner, as to cause the forward end of the prongs 12 to guide beneath pipe 17. The operator then pivots the bucket 21 in the usual manner to cause the pipe 17 to lay in the arcuate portions of prongs 12. The operator then lifts the fork 11 and pivots the bucket 21 and fork 11 combination away from the point of pick-up, and positions the fork 11 on the unloading site or vehicle that is to receive the pipe 17. After the abovementioned, the operator then pivots the bucket 21 and fork 11 combination, while lowering same, to discharge the pipe 17 smoothly therefrom.

While various changes may be made in the detailed construction, such detail will be within the scope and spirit of the present invention, as defined by the appended claims.

I claim:

1. A back hoe fork lifting device, comprising, a pair of mounting arms, for securing said device to a back hoe vehicle, a pair of fork arms received on said pair of mounting arms, a bar received on said pair of fork arms, a pair of channel clamps freely received on said bar, and an opening through said pair of channel clamps freely receives a bolt fastener, and said bolt fastener is one of a pair, and a plurality of equally spaced transverse openings through said bar receives each said bolt fastener, selectively, for adjustment spread of said pair of fork arms from each other, and each said bolt fastener is also freely received in an elongated cut-out opening through said pair of fork arms and provides adjustment means for elevating and lowering said bar on said pair of fork arms, and each said bolt fastener locks said bar at any desired elevation on said pair of fork arms, by a nut fastener received on each said bolt fastener.

* * * * *